US006602013B2

(12) United States Patent
Clark

(10) Patent No.: US 6,602,013 B2
(45) Date of Patent: Aug. 5, 2003

(54) CHEWABLE TOOTHBRUSH

(76) Inventor: Frank Clark, P.O. Box 205, Costilla, NM (US) 87524

( * ) Notice: Subject to any disclaimer, the term of this patent is extended or adjusted under 35 U.S.C. 154(b) by 0 days.

(21) Appl. No.: 09/940,334

(22) Filed: Aug. 27, 2001

(65) Prior Publication Data

US 2003/0039504 A1 Feb. 27, 2003

(51) Int. Cl.[7] ..... A46B 11/04
(52) U.S. Cl. ..... 401/282; 401/284
(58) Field of Search ..... 401/282, 283, 401/284, 268, 183, 132, 201, 196; 15/104.93, 104.94, 110, 167.1; 601/139, 141

(56) References Cited

U.S. PATENT DOCUMENTS 2,284,200 A * 5/1942 Gruss ..... 15/167.2
2,778,045 A * 1/1957 Bly et al. ..... 15/104.94
2,819,482 A * 1/1958 Applegate ..... 15/106
3,458,268 A * 7/1969 Wozab et al. ..... 15/244.1
3,769,652 A * 11/1973 Rainer ..... 15/167.2
3,853,412 A * 12/1974 Griffin ..... 401/183
4,149,815 A 4/1979 Kawam
4,237,911 A 12/1980 White
4,428,091 A * 1/1984 Janssen ..... 15/167.2
4,432,114 A 2/1984 Goudsmit
4,748,709 A * 6/1988 Oates ..... 15/104.93
5,445,825 A 8/1995 Copelan et al.
5,483,722 A * 1/1996 Scheier et al. ..... 15/167.1
6,205,611 B1 * 3/2001 Vigil ..... 15/244.1
6,334,231 B2 * 1/2002 Safieh ..... 15/167.1

* cited by examiner

*Primary Examiner*—Gene Mancene
*Assistant Examiner*—Huyen Le
(74) *Attorney, Agent, or Firm*—Gray Cary Ware & Freidenrich

(57) ABSTRACT

A chewable toothbrush includes a pliable bristle anchor, bristles attached to the bristle anchor, and a handle attached to the bristle anchor. In one embodiment, the bristle anchor includes a cavity that holds a material such as toothpaste or mouthwash. When the toothbrush is chewed, the material is released from the cavity and onto the bristles. The toothbrush may be realized as a single-use disposable unit or as a multiple-use unit. The cavity in a multiple-use unit can be reloaded with material prior to each use.

23 Claims, 6 Drawing Sheets

CHEWABLE TOOTHBRUSH

FIELD OF THE INVENTION

The present invention relates generally to toothbrushes. More particularly, the present invention relates to a toothbrush having a chewable bristle anchor.

BACKGROUND OF THE INVENTION

The prior art contains a vast number of different toothbrush designs. A manually operated toothbrush typically includes rows of bristles attached to a rigid head. The user holds the toothbrush against his teeth and moves the toothbrush to scrub the teeth. Conventional hand-held toothbrushes require manual manipulation to effectively clean the teeth. Some known toothbrushes are designed for a single use or for a limited number of uses. Such "temporary" of single-use toothbrushes also utilize a rigid bristle head and also require the user to manually manipulate the toothbrush.

Although the prior art contains many toothbrushes, most do not divert from the manual operation of the standard design. Accordingly, there exists a need for a toothbrush that cleans teeth in a new and unconventional manner.

BRIEF SUMMARY OF THE INVENTION

A toothbrush according to the present invention can include a chewable bristle anchor that enables the user to clean his teeth by chewing on the toothbrush. The user need not manipulate the toothbrush using the traditional brushing motion. Various single-use and multiple-use toothbrushes can be designed according to the techniques of the present invention.

The above and other aspects of the present invention may be carried out in one form by a toothbrush comprising a chewable bristle anchor having an uncompressed shape, a plurality of bristles attached to the bristle anchor, and a handle connected to the bristle anchor. The bristle anchor is configured to compress upon itself in response to application of an external force and to return to its uncompressed shape in response to removal of the external force.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

Figure 1:
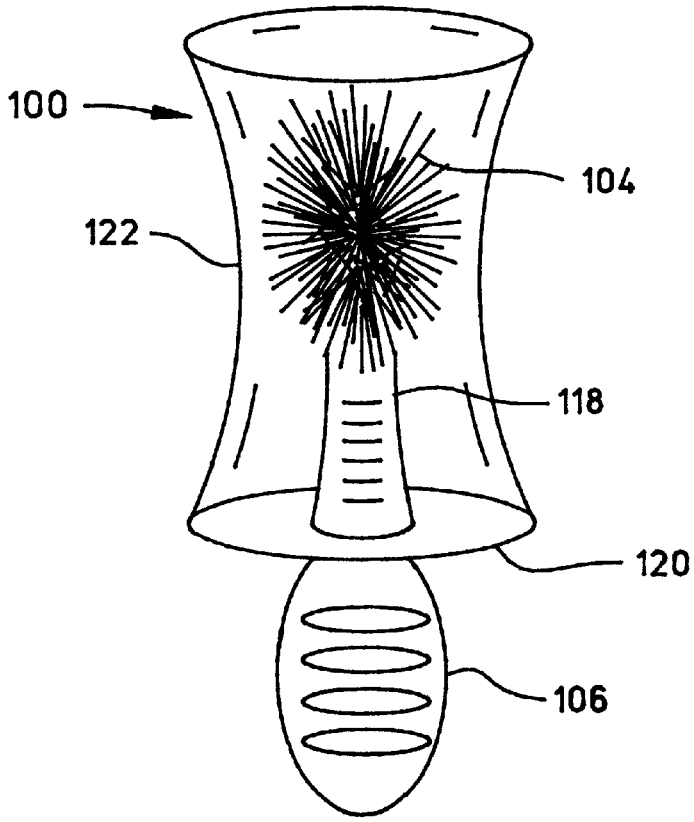
FIG. 1 is a perspective view of a toothbrush configured in accordance with the present invention.

FIG. 1 is a perspective view of a toothbrush 100 configured in accordance with the present invention. The example embodiment described herein is suitable as a single-use, disposable toothbrush. Alternatively, toothbrush 100 can be configured for use as a multiple-use toothbrush. Toothbrush 100 generally includes a chewable bristle anchor 102 (hidden from view in FIG. 1, but shown in FIGS. 2–5), a plurality of bristles 104 attached to bristle anchor 102, and a handle 106 connected to bristle anchor 102. As described in more detail below, bristle anchor 102 includes a cavity that holds a wetting material such as a liquid or gel mouthwash. The wetting material is released from the cavity as the user chews the toothbrush 100. Prior to use, the wetting material is temporarily sealed within the cavity with a layer of wax and/or a layer of toothpaste.

Figure 2:
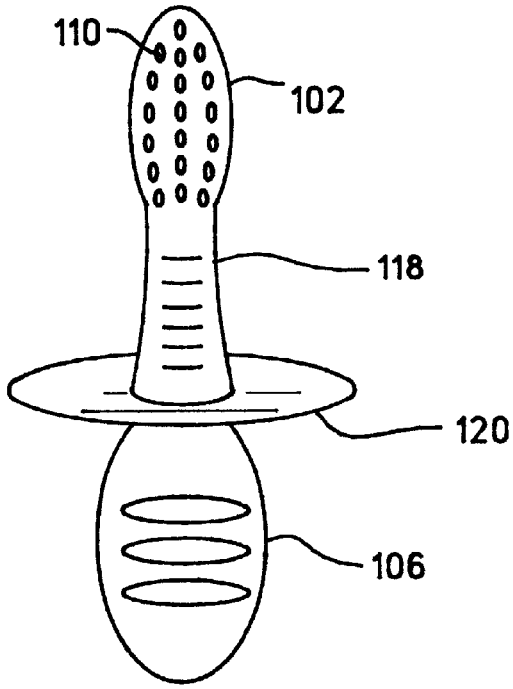
FIG. 2 is a perspective view of a bristle anchor suitable for use with the toothbrush shown in FIG. 1
Figure 3:
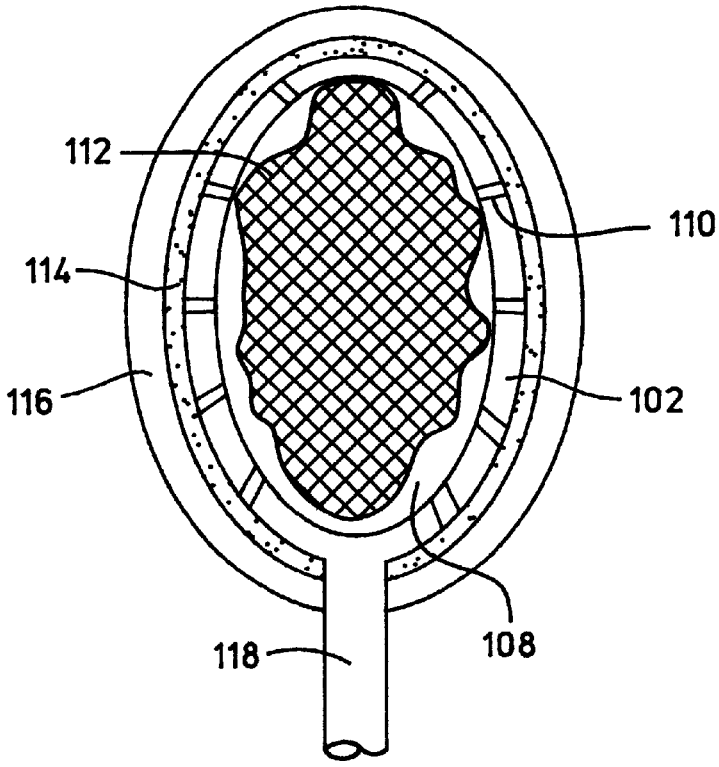
FIG. 3 is a cross sectional view of a portion of the toothbrush shown in FIG. 1.
Figure 4:
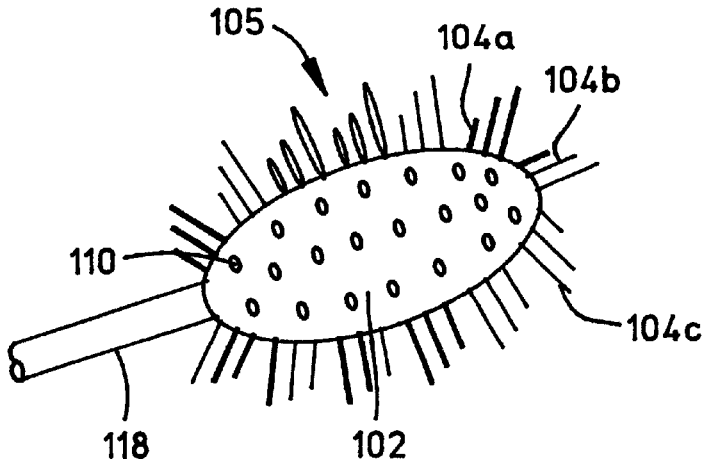
FIG. 4 is a plan view of a portion of the toothbrush shown in FIG. 1.
Figure 5:
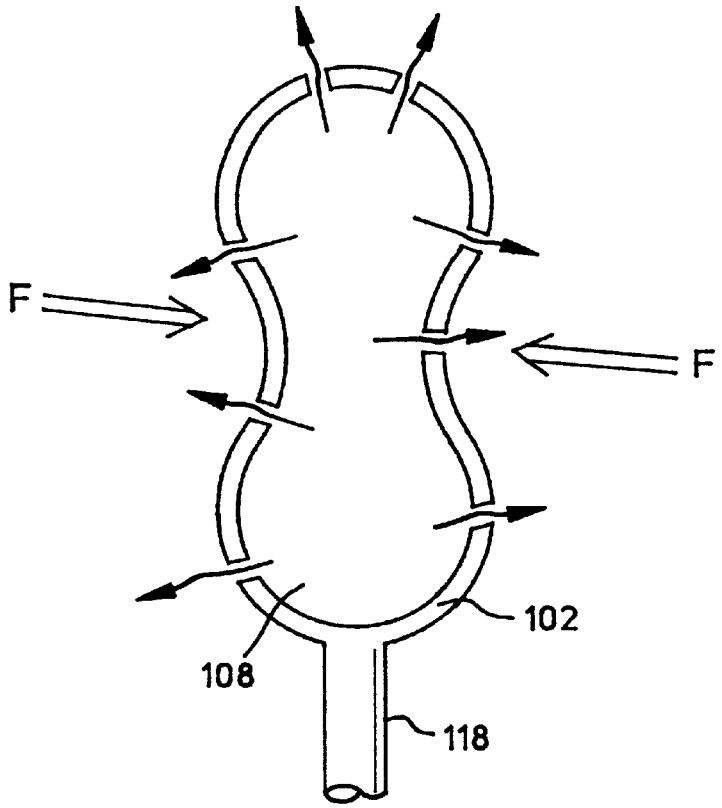
FIG. 5 is a schematic diagram of a bristle anchor in a compressed state.

Bristle anchor 102 is preferably formed from a pliable material that allows bristle anchor 102 to be compressed when chewed. Bristle anchor 102 is formed such that it initially holds an uncompressed shape (as shown in FIGS. 2–4). Although the shape of bristle anchor 102 may vary for a given toothbrush, the example embodiments utilize an oblong and football-shaped anchor. Bristle anchor 102 is configured to compress upon itself in response to the application of an external force (such as a chewing force) and to return to the uncompressed shape in response to removal of the external force. FIG. 5 depicts bristle anchor 102 in a deformed or compressed shape resulting from the application of an external force F. Bristle anchor 102 can be formed from a resilient material having elastic memory that allows it to return to its original shape. As an example, bristle anchor 102 can be formed from any suitable plastic, rubber, nylon, composite, or other material. The hardness, resiliency, elasticity, tensile strength, and other physical properties of bristle anchor 102 can be selected according to the particular design.

The bristles 104 can be attached to bristle anchor 102 in any suitable manner. For example, bristles 104 may be molded into bristle anchor 102, inserted and bonded into holes formed in bristle anchor 102, or the like. In a practical embodiment, bristles 104 may be located in a random manner or in a specific pattern suited to the shape, size, or application of toothbrush 100. For example, in one practical embodiment, the plurality of bristles 104 includes a plurality of short bristles 104*a*, each having a relatively low stiffness, a plurality of intermediate bristles 104*b*, each having a relatively intermediate stiffness, and a plurality of long bristles 104*c*, each having a relatively high stiffness (see FIG. 4). Short bristles 104*a* act as the first layer of bristles, which are applied to the users gum line. In use, the chewing motion causes the short bristles 104*a* to gently push against and massage the gum line, thus removing foreign material and plaque from the gum line. Intermediate bristles 104*b* act as the second layer of bristles. Intermediate bristles 104*b* clean plaque and debris below the gum line and reach in the crevices located between the teeth. The layer of intermediate bristles 104*b* also functions to clean the overall surface of each tooth and the gums. Long bristles 104*c*, clean and stimulate the bottom and roof of the mouth and the tongue. In one practical embodiment, short bristles 104*a* are each approximately ⅛ inch long, intermediate bristles 104*b* are each approximately ¼ inch long, and long bristles 104*c* are each approximately ⅜ inch long. For purposes of illustration, FIG. 4 only shows a small number of bristles 104; a practical toothbrush 100 includes a larger number of densely arranged bristles 104 (as shown in FIG. 1).

The bristles may be formed as single strands, as represented by bristles 104, or as looped strands, as represented by bristles 105 (see FIG. 4). The looped bristles 105 may be employed to reduce irritation of the mouth and gums while chewing the toothbrush. As shown in FIG. 5, the looped biistele bristles 105 may have different lengths and stiffness (as described above in connection with bristles 104).

The resiliency of bristle anchor 102 changes the angle of the bristles 104 with every bite. In response to the chewing motion, the bristles 104 move and "pinch down" upon the teeth and gums to loosen and remove foreign particles. The different bristle lengths and different bristle stiffness, combined with the compression of bristle anchor 102 during chewing, stimulates the gums and mouth in an unconventional manner.

As shown in FIG. 3 and FIG. 5, bristle anchor 102 includes a cavity 108 formed therein. Cavity 108 is suitably configured to hold a substance (e.g., water, mouthwash, a liquid gel, a dentifrice such as toothpaste or tooth powder, a wetting material, or the like) that is released when an external force is applied to bristle anchor 102. For safety, the substance should be edible and nontoxic. The toothbrush may be specifically sized for use by adults or children, i.e., the size of bristle anchor 102 and cavity 108 can be relatively small or relatively large depending upon the intended use. For example, cavity 108 may be sized to contain any volume of material, e.g., between 2 to 10 milliliters. As best shown in FIG. 2 and FIG. 4, a number of seep holes 110 may be formed in bristle anchor 102; seep holes 110 are suitably configured to release the substance contained in cavity 108. As depicted in FIG. 5, when bristle anchor 102 is compressed, the substance contained in cavity 108 squeezes through seep holes 110. In one embodiment, seep holes 110 are each approximately 1/32 inch in diameter. Of course, the size, shape, and arrangement of seep holes 110 can vary according to the particular design and application of toothbrush 100. When toothbrush 100 is being chewed, the substance exits cavity 108 and eventually comes into contact with the exposed portions of toothbrush 100 and into contact with the user's teeth.

In lieu of seep holes 110, bristle anchor 102 can include slits, cracks, capillaries, fissures, or any suitable conduit configured to transfer the substance from inside the cavity 108 to outside the cavity 108. Indeed, bristle anchor 102 may be formed from a porous material capable of releasing the substance via a seeping or leaching action. Alternatively, bristle anchor 102 can be formed from an absorbent material such as a sponge material or a foam material. In lieu of a substance contained in a cavity, the absorbent material may be impregnated with a suitable substance that is released as the user chews the toothbrush.

As mentioned above, toothbrush 100 can be configured as a single-use disposable unit. In addition, toothbrush 100 can be configured such that the user need not apply water or otherwise pre-wet bristles 104 prior to use. FIG. 3 is a cross sectional view of a portion of toothbrush 100 (the head portion). For the sake of clarity, bristles 104 are not shown in FIG. 3. As described above, the illustrated embodiment includes bristle anchor 102 having seep holes 110 formed therein. Bristle anchor 102 includes a hollow portion that forms cavity 108. For the "waterless" version of toothbrush 100, a suitable wetting material 112 is contained in cavity 108. Wetting material 112 preferably serves to wet bristles 104 and the user's teeth. In this regard, wetting material 112 can be water, mouthwash, disinfectant, or any appropriate lubricant. In addition, wetting material 112 may be a liquid, a gel, a number of liquid-filled capsules, or the like.

Toothbrush 100 may include a sealant 114 formed around bristle anchor 102; sealant 114 is configured to temporarily seal wetting material 112 within cavity 108. Prior to use, sealant 114 prevents wetting material 112 from being prematurely released from seep holes 110. In a practical embodiment, sealant 114 substantially surrounds bristle anchor 102 to ensure that all seep holes 110 are covered. In accordance with an example embodiment, sealant 114 comprises a wax layer having a thickness between 1/16 inch and 1/8 inch. Alternatively, sealant 114 may include a dentifrice (such as toothpaste), a wax-dentifrice blend, a gum-like substance, or any material capable of forming a temporary seal around bristle anchor 102.

Sealant 114 is relatively hard prior to use and becomes relatively soft during use. When chewed, mixed with the substance (preferably a liquid or gel) released from cavity 108, and warmed by the user's mouth, sealant 114 becomes soft and capable of trapping dislodged particles. In this manner, sealant 114 also functions to remove food, plaque, and other particles from the user's teeth, gums, and mouth.

Toothbrush 100 may also include a dentifrice 116 formed around bristle anchor 102. Dentifrice 116 may be a dried toothpaste, molded tooth powder, a tooth gel, or the like. In the example embodiment shown in FIG. 3, dentifrice 116 is formed around sealant 114 to a thickness between 1/16 inch and 1/8 inch. Thus, sealant 114 can be surrounded by a layer of dentifrice 116. Alternatively, the dentifrice alone can also serve as the sealant. Alternatively, the layer of dentifrice may be surrounded by the layer of sealant. Notably, sealant 114 and dentifrice 116 are formed between bristles 104, which can help to retain sealant 114 and dentifrice 116 on bristle anchor 102 during manufacturing, shipping, and storage.

Figure 7:
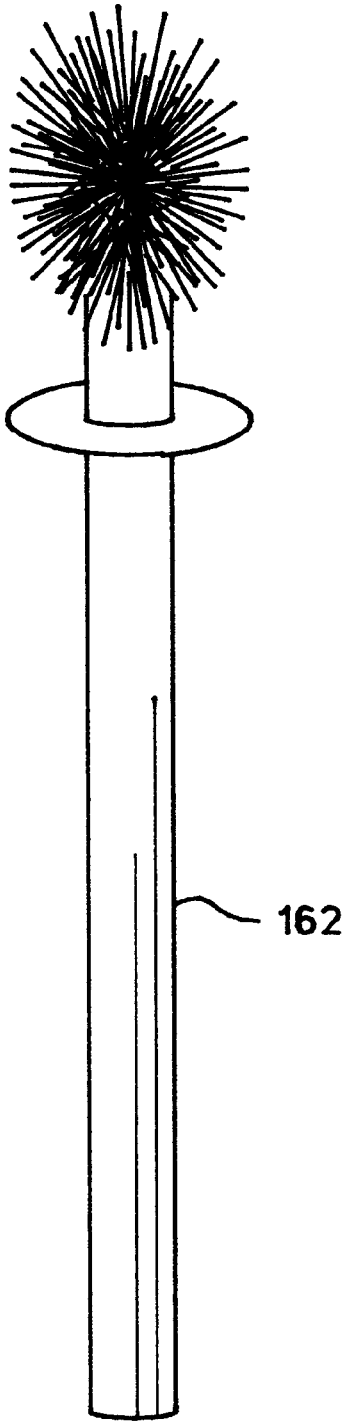
FIGS. 7–9 are perspective views of various toothbrushes configured in accordance with the present invention.

When new, toothbrush 100 may be packaged as shown in FIG. 1. The bristle anchor is attached to handle 106, which may include a stem 118 and/or a lip shield 120. Stem 118 may be formed from the same chewable material as the bristle anchor, or it may be formed from any suitable material such as plastic. Stem 118 may be rigid, adjustable, or flexible, depending upon the particular design. Lip shield 120 helps to position toothbrush 100 in the user's mouth and prevents toothbrush 100 from being swallowed or being fully inserted into the user's mouth. Handle 106 may be realized as a finger hold configuration (as shown in FIG. 1) or as a more conventional configuration (as shown in FIG. 7). Although not a requirement of the present invention, the bristle anchor, stem 118, lip shield 120, and handle 106 may be formed as an integral unit via injection molding or any suitable manufacturing process.

Toothbrush 100 may also include a removable protective enclosure 122 that surrounds at least the bristles 104. In the illustrated example, protective enclosure 122 covers bristles 104, the bristle anchor, stem 118, and a portion of lip shield 120. Protective enclosure 122 can be removed prior to use. In a practical embodiment, protective enclosure 122 is a plastic wrapper or a molded plastic cap.

When toothbrush 100 is initially chewed, the outer layers of dentifrice 116 and sealant 114 are loosened and compressed against bristle anchor 102. The compression of bristle anchor 102 results in a squeezing action that forces wetting material 112 out of cavity 108, as depicted in FIG. 5. The chewing action imparts an external force Fon bristle anchor 102, and wetting material 112 is released from cavity 108 in response to the force (the small arrows in FIG. 5 represent the movement of wetting material 112). Wetting material 112 eventually becomes mixed with dentifrice 116 and sealant 114. If wax is used as sealant 114, the wax traps dislodged food particles and plaque as toothbrush 100 is chewed. After chewing, the user can discard toothbrush 100.

Figure 6:
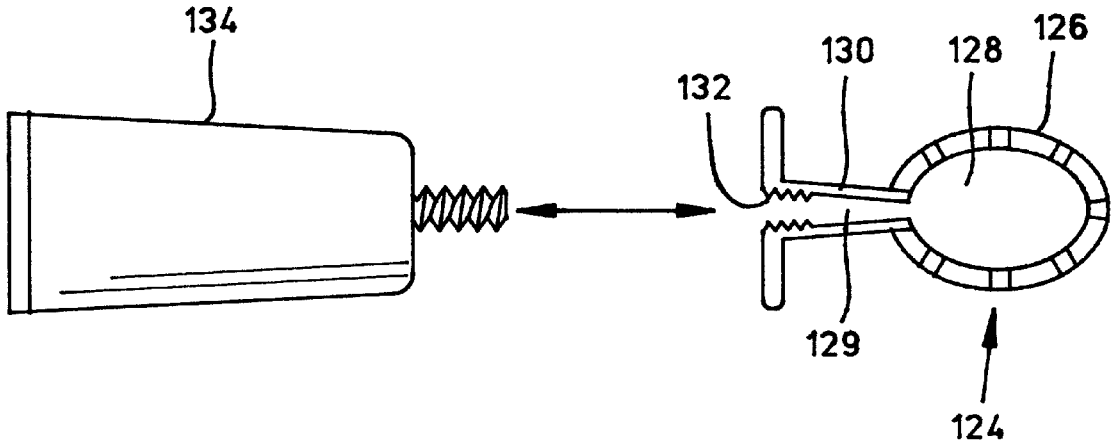
FIG. 6 is a schematic diagram of a portable bristle anchor.

FIG. 6 depicts a portion of an alternate toothbrush 124 according to the present invention. Toothbrush 124 includes many of the features described above in connection with toothbrush 100. For example, toothbrush 124 includes a bristle anchor 126 (the bristles are not shown in FIG. 6) having a cavity 128 formed therein. An entryway 128 formed in bristle anchor 126 is configured to accommodate insertion of a substance into cavity 128. As described above, the substance may be a dentifrice, mouthwash, or the like. The embodiment shown in FIG. 6 includes entryway 129 formed within a handle 130 of toothbrush 124; entryway 129 is coupled to cavity 128 such that the substance can be loaded into cavity 128. Alternatively, the entryway can be formed within bristle anchor 126 or at any suitable location that communicates with cavity 128.

A suitable coupler 132 may also be formed within handle 130. Coupler 132 is suitably configured to mate with a dispenser 134 for the substance. In this regard, coupler 132 may be formed within handle 130 at an end of entryway 129. In a practical implementation, coupler 132 is realized as an internally threaded portion of entryway 129. The internal thread pattern mates with the external thread pattern of a dentifrice dispenser such as a tube of toothpaste. Toothbrush 124 can be reloaded with dentifrice after each use by attaching handle 130 to dentifrice dispenser 134. Toothbrush 124 can remain on dentifrice dispenser 134 during use, it can be removed and used by gripping handle 130, or it can be removed and attached to a suitably configured extended handle 136 (see FIG. 8).

Figure 9:
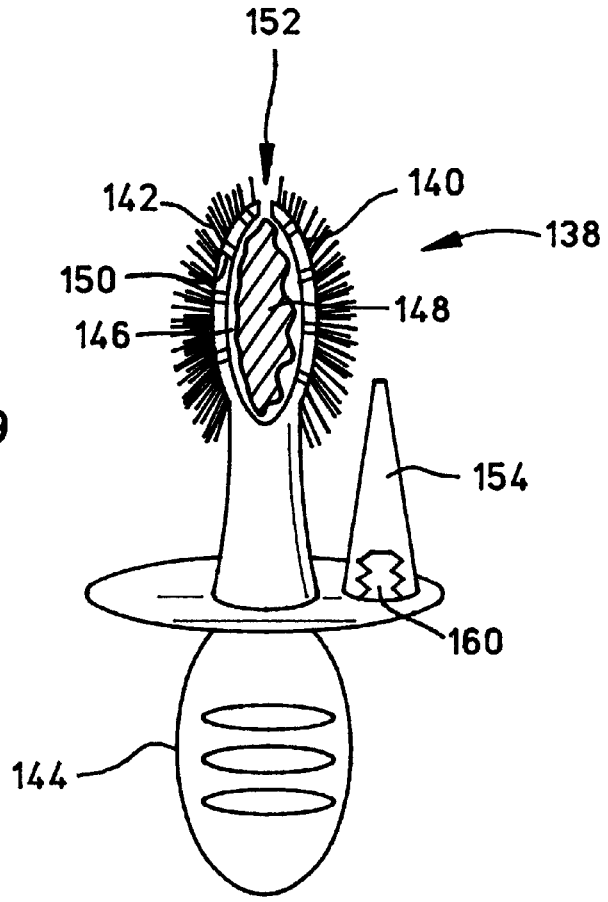

FIG. 9 is a schematic representation of an alternate toothbrush 138 configured in accordance with the present invention. For purposes of illustration, FIG. 9 shows portions of toothbrush 138 removed. Toothbrush 138 shares several features with toothbrush 100. For example, toothbrush 138 includes a chewable bristle anchor 140, a plurality of bristles 142 attached to bristle anchor 140, a handle 144, a cavity 146 formed within bristle anchor 140, a suitable material 148 contained within cavity 146, and a number of seep holes 150 formed within the outer wall of bristle anchor 140.

Bristle anchor 140 may include an entryway 152 formed therein; entryway 152 is suitably configured to accommodate the insertion of the material 148 into cavity 146. Again, the material 148 may be a dentifrice (e.g., toothpaste, tooth powder, or tooth gel), mouthwash, a wetting agent, or the like. Entryway 152 enables toothbrush 138 to be reloaded with material before each use. In this regard, toothbrush 138 need not be a single-use or disposable unit.

Figure 10:
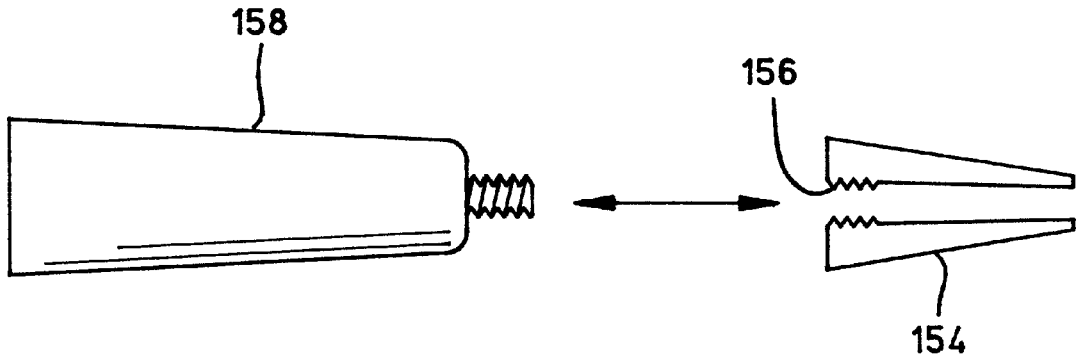
FIG. 10 is a schematic diagram of a fitting and a tube of toothpaste.
Figure 11:
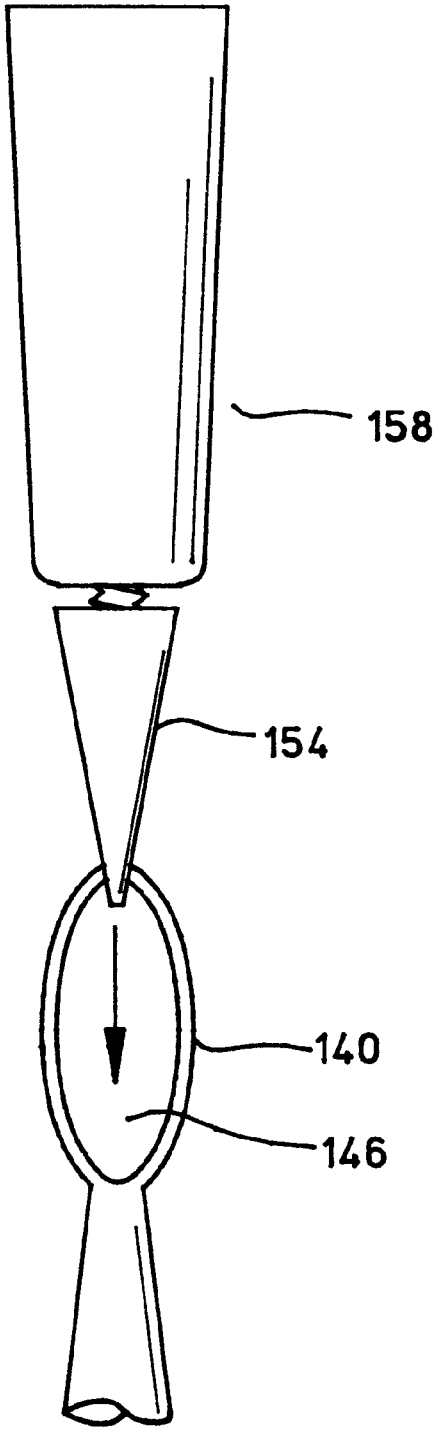
FIG. 11 is a schematic diagram illustrating a technique for dispensing toothpaste into a cavity formed within a bristle anchor.

Toothbrush 138 may also include a fitting 154 configured to dispense the material 148 into cavity 146. As shown in the cross section of FIG. 10, fitting 154 may be a hollow cone having a coupler 156 that mates with a dispenser 158 for the substance that is loaded into cavity 146. In the example embodiment, coupler 156 is realized as an internally threaded portion of fitting 154 and coupler 156 screws onto a threaded portion of dispenser 158 (which may be a tube of toothpaste). As depicted in FIG. 11, fitting 154 can be inserted into entryway 152 to facilitate the insertion of the material into cavity 146. After loading cavity 146 with the material, fitting 154 can be removed from dispenser 158 and returned to a corresponding coupler 160 on handle 144 for storage (see FIG. 9). In practice, coupler 160 may be a suitably threaded prong that receives the internal threads formed in fitting 154.

Figure 8:
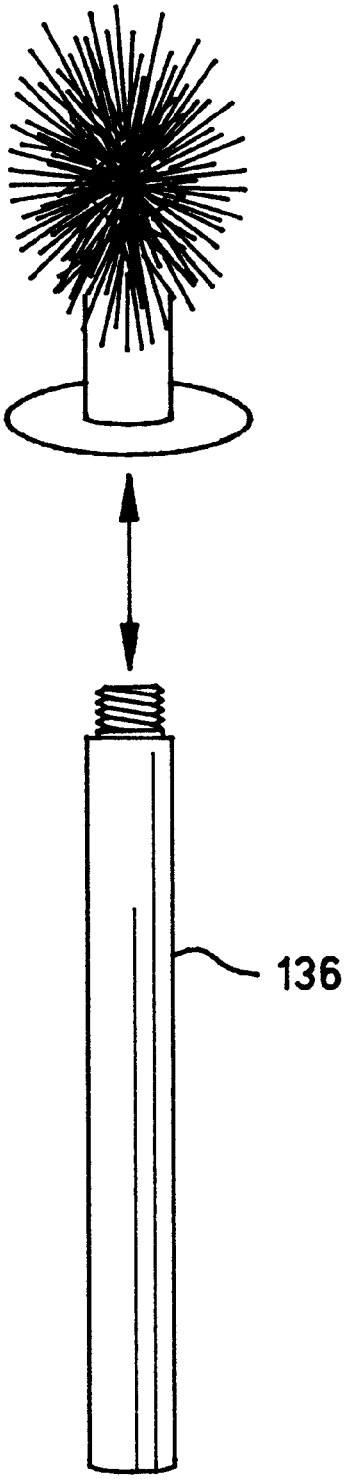

FIG. 7 is a perspective view of a toothbrush having an extended handle 162, and FIG. 8 is a perspective view of a toothbrush having a removable extended handle 136. A toothbrush configured according to the present invention may include a short finger handle (as shown in FIG. 1 and FIG. 9) or an extended handle as shown in FIG. 7. Alternatively, a toothbrush configured according to the present invention may include a removable head portion that mates with an extended handle (as shown in FIG. 8), a dispenser (as shown in FIG. 6), or any other compatible object. In other words, the techniques of the present invention can be applied to a number of different practical embodiments.

The present invention has been described above with reference to various preferred embodiments, and the particular implementations shown and described herein are illustrative of the invention and its best mode and are not intended to otherwise limit the scope of the invention in any way. Indeed, certain changes and modifications may be made to the preferred embodiments without departing from the scope of the present invention. These and other changes or modifications are intended to be included within the scope of the present invention, as expressed in the following claims.

What is claimed is:

1. A toothbrush comprising:

a chewable bristle anchor formed from a pliable and resilient material and having an uncompressed shape, said bristle anchor being configured to compress upon itself in response to application of an external force and to return to said uncompressed shape in response to removal of said external force;

a plurality of bristles attached to said bristle anchor; and a handle connected to said bristle anchor; wherein said plurality of bristles comprises:

a plurality of short bristles, each having a relatively low stiffness;

a plurality of intermediate bristles, each having a relatively intermediate stiffness;

a plurality of long bristles, each having a relatively high stiffness.

2. A toothbrush according to claim 1, wherein said bristle anchor is formed from an absorbent material.

3. A toothbrush according to claim 1, wherein said bristle anchor is formed from a porous material.

4. A toothbrush according to claim 1, further comprising a cavity formed within said bristle anchor, said bristle anchor being further configured to release a substance contained in said cavity in response to application of said external force.

5. A toothbrush according to claim 4, wherein said substance comprises a dentifrice.

6. A toothbrush according to claim 4, further comprising an entryway formed in said bristle anchor, said entryway being configured to accommodate insertion of said substance into said cavity.

7. A toothbrush according to claim 4, further comprising:

an entryway formed within said handle, said entryway being coupled to said cavity to accommodate insertion of said substance into said cavity; and a coupler formed within said handle at an end of said entryway, said coupler being configured to mate with a dispenser for said substance.

8. A toothbrush comprising:

a chewable bristle anchor formed from a pliable material, said bristle anchor being configured to compress upon itself in response to application of an external force;

a cavity formed within said bristle anchor;

a substance contained in said cavity, said bristle anchor being further configured to release said substance in response to application of said external force;

a plurality of bristles attached to said bristle anchor; and a sealant formed around said bristle anchor, said sealant being configured to temporarily seal said substance within said cavity.

9. A toothbrush according to claim 8, further comprising a plurality of seep holes formed in said bristle anchor, said seep holes being configured to release said substance.

10. A toothbrush according to claim 8, wherein said substance comprises a wetting material.

11. A toothbrush according to claim 10, wherein said substance comprises a mouthwash.

12. A toothbrush according to claim 8, wherein said substance comprises a dentifrice.

13. A toothbrush according to claim 8, wherein said bristle anchor is formed from a porous material.

14. A toothbrush according to claim 8, wherein said sealant comprises wax.

15. A toothbrush according to claim 8, wherein said sealant comprises a dentifrice.

16. A toothbrush according to claim 8, further comprising a dentifrice formed around said bristle anchor.

17. A toothbrush according to claim 16, wherein said dentifrice is formed around said sealant.

18. A toothbrush according to claim 8, wherein said sealant is formed between said plurality of bristles.

19. A toothbrush according to claim 8, further comprising a removable protective enclosure surrounding said plurality of bristles.

20. A toothbrush according to claim 8, further comprising an entryway formed in said bristle anchor, said entryway being configured to accommodate insertion of said substance into said cavity.

21. A toothbrush according to claim 20, further comprising a fitting configured to dispense said substance into said cavity.

22. A toothbrush according to claim 21, wherein said fitting includes a coupler configured to mate with a dispenser for said substance.

23. A toothbrush according to claim 22, further comprising a handle connected to said bristle anchor, said handle being configured to mate with said coupler for storage of said fitting.

* * * * *